United States Patent [19]

Goodale

[11] Patent Number: 4,794,658

[45] Date of Patent: Jan. 3, 1989

[54] MATTRESS COVER HAVING COLORED BACKING

[75] Inventor: Clark W. Goodale, Simi Valley, Calif.

[73] Assignee: American National Watermattress Corporation, Anaheim, Calif.

[21] Appl. No.: 15,361

[22] Filed: Feb. 17, 1987

[51] Int. Cl.[4] ..... A47C 27/00; A47C 31/02

[52] U.S. Cl. ..... 5/448; 5/470; 5/451

[58] Field of Search ..... 5/448, 451, 470–473, 5/482, 500–502; 428/102

[56] References Cited

U.S. PATENT DOCUMENTS

| | | | |
|---|---|---|---|
| 3,287,749 | 11/1966 | Marsico | 5/470 X |
| 3,774,250 | 11/1973 | Miller | 5/471 |
| 4,062,077 | 12/1977 | Autrey et al. | 5/500 X |
| 4,186,455 | 2/1980 | Fox, Jr. et al. | 5/451 |
| 4,424,600 | 1/1984 | Callaway | 5/470 |

*Primary Examiner*—Michael F. Trettel

*Attorney, Agent, or Firm*—Richard L. Myers

[57] ABSTRACT

A mattress construction includes a watermattress bladder or inner spring mattress subassembly which is enclosed in a quilted mattress cover. This cover typically includes an outer fabric, a backing and an inner fabric which are quilted together. The outer fabric is colored and typically provided with a pattern or indicia. The fabric itself consists of a loose weave of threads providing openings or interstices in the fabric. The backing, typically formed of foam or fiber, is provided with pigments which are visible through the interstices of the fabric and provide a background color for the color in the fabric. In this manner, the pigments in the backing material enhance the distinct images of the indicia and add to the depth and richness of the mattress color. This provides the mattress cover with substantially colorfast characteristics increasing its chroma and color quality to provide an attractive, long lasting, appealing appearance.

16 Claims, 1 Drawing Sheet

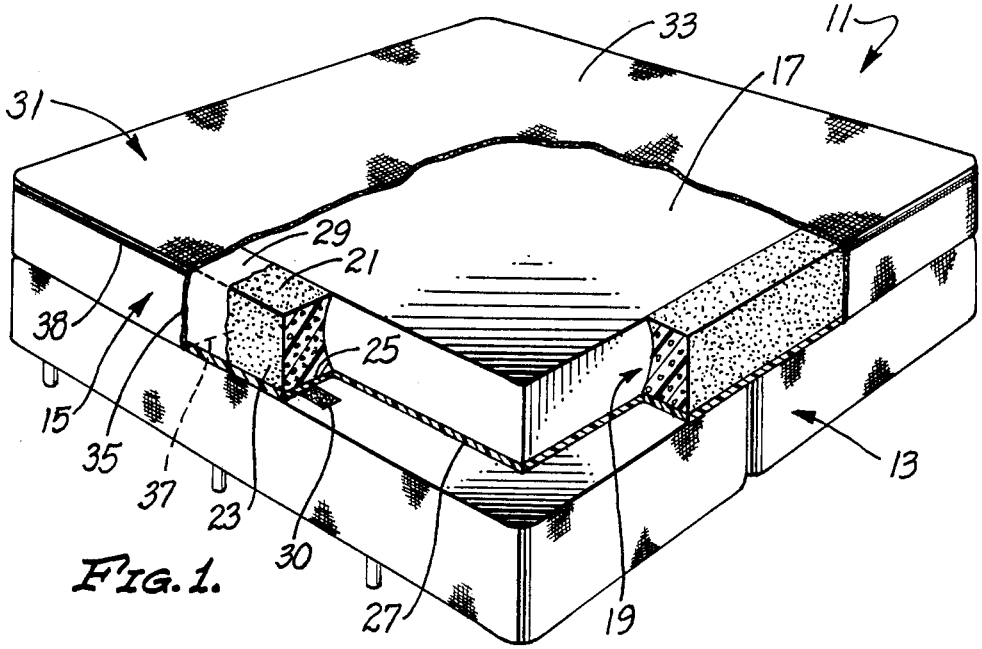
FIG. 1.
FIG. 2.
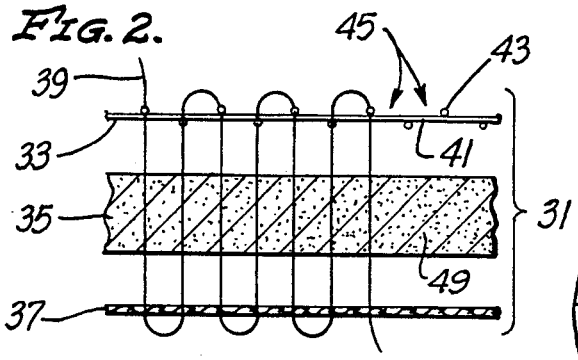
FIG. 4.
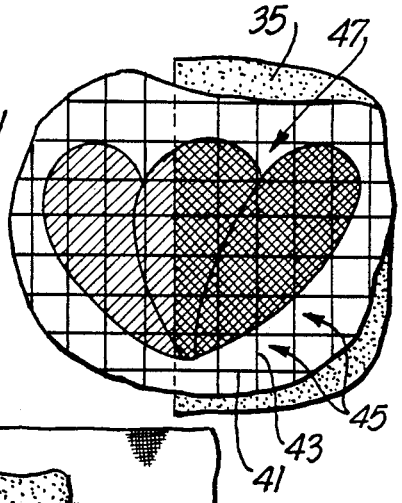
FIG. 3.
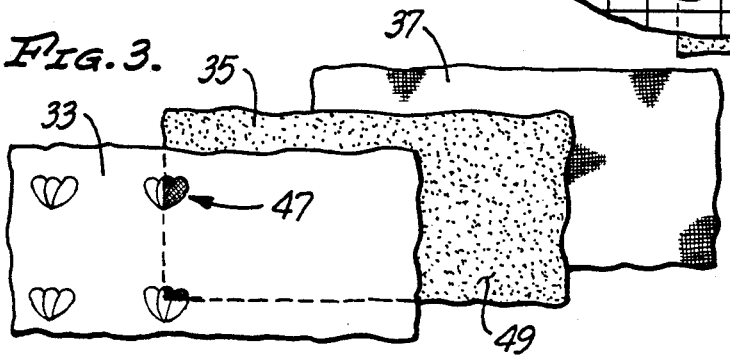

MATTRESS COVER HAVING COLORED BACKING

BACKGROUND OF THE INVENTION

1. Field of the Invention

This invention relates generally to mattresses, both watermattresses and box spring mattresses, having mattress covers typically of the quilted variety including an outer fabric and a foam or fiber backing.

2. Discussion of the Prior Art

Mattresses, including both watermattresses and box spring mattresses, typically include an interior subassembly comprising a water bladder or metal springs respectively, and an exterior covering which surrounds the interior subassembly. The exterior covering, typically referred to as a mattress cover, is commonly of a quilted construction wherein an outer fabric is sewn to an inner material such as a urethane foam or a fiber backing. The backing and the quilting construction provides an aesthetic appearance as it adds loft to the mattress cover. The aesthetic appearance is further enhanced by a colored pattern or indicia which typically has been printed onto the visible surface of the mattress cover.

It has been particularly disappointing that the brilliant colors associated with the mattress cover and the high contrasting color of the indicia on the fabric has degraded over relatively short periods of time. Although the mattress has presented a brilliant appearance in the showroom, this color degradation over time has left the mattress with a dull lifeless color in periods as short as nine to twelve months. Both the fabric and the indicia of the mattress covers have tended to fade and lose the high contrast of the original product.

Attempts have been made to reduce the color degradation of the mattress cover; these attempts have been focused primarily on the indicia and the fabric itself. For example, it has been found that if the indicia is applied to the fabric using a heat transfer process, the indicia itself is less apt to degrade with exposure to ozone and ultraviolet light. This has increased the color fast characteristics of the product. However, the yellowing of the urethane foam has continued to degrade the color quality of even the heat transferred indicia.

SUMMARY OF THE INVENTION

In accordance with the present invention, this problem of the prior art associated with color degradation of the mattress cover has now been overcome. Focusing away from the teachings of the prior art, it has been found that the color degradation of the mattress cover over time is associated not with the indicia or the fabric color, but rather with the backing disposed next to the side of the fabric opposite the indicia. This backing has been constructed of a urethane foam or fiber and typically a polyurethane or polyester foam.

These materials have initially been provided in their natural white color, but it has been found that over time their response to ozone and ultraviolet rays has turned this white color into a dull mustard or yellow color. It is now believed that this aging, dull color showing through the interstices of the mattress cover fabric has been most responsible for the color degradation of the mattress cover.

In accordance with the present invention, a pigment is added to this backing material. This pigment is not responsive to ozone or ultraviolet rays and tends to override any tendency of the backing material to change color. As a consequence, the color showing through the fabric maintains a generally constant color and hue over time. As a result, both the original and ultimate colors of the fabric and indicia are maintained. In short, the mattress cover as a whole appears to be color fast.

Depending on the colors chosen for the backing, the fabric cover, and the indicia, the original colors can be provided with an increased depth, richness and quality. For example, a medium blue fabric provided with light blue indicia will have a substantially increased chroma, color quality, and richness when placed over a gray backing material. The darker backing showing through the fabric adds to the purity of the fabric and indicia color, and provides for more distinct images. All of these advantages combine to provide an initial product which is highly attractive and appealing and which maintains that appearance over time.

These and other features and advantages associated with the present invention will be more apparent from a description of preferred embodiments and referenced to the associated drawings.

DESCRIPTION OF THE DRAWINGS

FIG. 1 is a perspective view of a waterbed partially in phantom and illustrating a watermattress having a mattress cover associated with the present invention;

FIG. 2 is an assembly side view of the quilting associated with one embodiment of the mattress cover of the present invention;

FIG. 3 is an assembly plan view of the three layers of material forming the mattress cover in a preferred embodiment of the invention; and FIG. 4 is an exploded view of a small area of the fabric and backing illustrated in FIG. 3.

DESCRIPTION OF PREFERRED EMBODIMENTS

A waterbed is illustrated in FIG. 1 and designated generally by the reference numeral 11. This waterbed 11 consists of a foundation 13 of any conventional variety including those incorporating box springs. The foundation 13 rests upon a floor and is adapted to support a watermattress 15.

In the illustrated embodiment, the watermattress 15 is of the hybrid type having a bladder 17 and a foam sidewall 19 extending around the periphery of the bladder. The sidewall 19 includes a top surface 21, a lateral surface 23, and a bottom surface 25. The top surface 21 extends substantially coplanar to the top of the bladder 17, while the lateral surface 23 provides a substantially vertical sidewall for the mattress 15.

The bottom surface 25 can be glued to a foam panel 27, which extends over substantially the entire bottom surface of the mattress 15. It follows that the sidewall 19 in combination with the foam panel 27, forms a cavity which is adapted to receive the bladder 17. This cavity is typically lined with a waterproof liner 29 which can extend over the surfaces 21, 23, and 31 of the sidewall 19.

As an aid to maintaining the sidewall structure in position around the periphery of the foundation 13, the bottom surface of the foam panel 27 can be releasibly adhered to the foundation 13 by a strip of hook and loop tape 30.

The bladder 17, sidewall 19, foam panel 27 and liner 29 are enveloped in a mattress cover 31 which includes a top panel 33, a lateral panel 35, and a bottom panel 37. The top panel 33 is preferably joined to the lateral panel 35 by a zipper 38 which provides access to the bladder 17. It is this mattress cover 31 which of primary interest to the present invention.

Although this particular embodiment shows the mattress cover 31 enclosing a waterbed structure, it will be appreciated that the mattress cover 31 and its improved color characteristics, can be equally advantageous to other types of mattress constructions. For example, typical inner spring and foam mattresses are also provided with mattress covers which can be of the type represented by the present invention. For this reason, further discussion of the mattress cover 31 in the illustrated waterbed embodiment, will apply equally to these other types of constructions.

With reference now to FIG. 2, it will be apparent that the mattress cover 31 of the present invention may include a ticking or outer fabric 33, a backing material 35, and an inner fabric 37. In this particular embodiment, these components 33, 35 and 37 are quilted together by a thread 39.

The outer fabric 33 is typically of a woven variety including warp threads 41 and woof threads 43. These threads 41 and 43 are typically loosely woven to an extent that openings or interstices 45 of the threads 41 and 43 occur in the fabric 33. It is these interstices 45 which permit one to see the backing 35 through the fabric 33. It follows that the interstices 45 have permitted the degrading color of the backings 35 to be visible from the other side of the fabric 33 and thereby dull the appearance of the mattress covers of the prior art. Now with the solutions associated with the present invention, these interstices 45 permit the colored backing 35 to contribute to and in fact enhance the color quality of the mattress cover 31. This enhancement contributes not only to the color or purity of the fabric itself, but also to the indicia 47 (best illustrated in FIG. 3) which may be printed or heat transferred onto the fabric 33.

The backing 35 is typically formed from a urethane material such as polyester, polyether or polyurethane. The configuration of the backing 35 may be of either foam or fiber. Most commonly, a polyester foam, which may have a thickness of approximately one inch, is used for the backing 35.

As previously discussed, the characteristics of this backing material, such as polyurethane, are such that its original white color tends to degrade to a dull mustard or yellow color over time. The effect of this color showing through the interstices 45 of the fabric 33 has resulted in considerable color dulling and degradation of the mattress cover 31 as a whole.

In accordance with the present invention, a pigment 49 is added to the backing 35. It is the purpose of the pigment 49 to dominate the natural color of the backing 35. Then any decoloration of the natural material is not readily apparent through the interstices 45 of the fabric 33. The color of this pigment 49 can be chosen relative to the color of the fabric 33 and the indicia 47 to provide a desired effect. For example, it is often desirable that the pigments associated with the fabric 33 and the indicia 47 be lighter in color than the pigment 49 associated with the backing 35. In most cases, it has been found that the darker background color of the pigment 49 tends to enhance the contrast of the indicia 47 relative fabric 33.

The inner fabric 37 is typically of a non-woven construction and is provided, particularly in the waterbed embodiments, to separate the foam 35 from the vinyl of the bladder 17. Relative movement of these two materials against each other, which typically results from a person moving on the bed, can produce objectionable sounds. It is the purpose of the inner fabric 37 to separate the backing 35 and the bladder 17 so that they do not come into contact and produce these audible noises.

The quilting of these three items, the outer fabric 33, the backing 35, and the inner fabric 37, not only maintain these elements as a single unit, but also provide the mattress cover with an attractive loft.

The backing 35 can be a separate foam or fiber construction which adds loft to the quilted configuration. However, the color enhancement characteristics can be achieved with other types of backing which may, for example, be painted or otherwise adhered to the inner surface of the fabric 33.

Referring now to FIG. 3, the plan view more readily illustrates the function of the pigment 49 in the backing 35 as viewed from the opposite side of the fabric 33. When the fabric 33 is not provided with a backing, or is placed over a backing which has a generally white appearance, it can appear very diluted, washed out and indistinct. However, when the backing 35 is placed in close proximity to the fabric 33, it shows through the interstices 45 and thereby enhances the purity, richness and chroma of the color present in the fabric 33 and the indicia 47.

With respect to the pigment 49 in the backing 35, it has been found that a generally dark pigment most advantageously enhances the darker tones of color in the fabric 33 and indicia 47. For example, a gray backing 35 increases the depth and richness of fabric colors such as pink, blue and green. This color is also preferred for generally white fabrics 33. In contrast, white pigment can most advantageously be added to the backing 35 in the case of fabrics 33 which are gold or yellow. While the white pigment in the backing 35 would not initially differ much from the natural color of the prior art material, ultimately, it will increase the colorfast properties of the mattress cover 31 as the white pigment dominates over the natural color.

With a description of these preferred embodiments, it will now be apparent to those skilled in the art that this concept can be embodied in many different forms and assemblies. For that reason, the scope of the present invention should be ascertained only with reference to the following claims.

I claim:

1. A mattress construction including:

interior means having characteristics for enhancing the comfort of a person lying on the mattress;

exterior means for enclosing the interior means, the exterior means providing a surface adapted to contact the person lying on the mattress;

a ticking included in the exterior means in the form of a loosely woven fabric having indicia thereon;

a foam backing material included in the exterior means between the ticking and the interior means, said backing material being visible through the loosely woven fabric;

a color pigment included in the backing material and providing a colored background for the ticking and the indicia thereon; whereby the colored background provides an increase in the color quality of the ticking and the indicia on the fabric.

2. The mattress recited in claim 1 wherein the backing material is a urethane foam.

3. The mattress recited in claim 2 wherein the foam is quilted to the ticking.

4. The mattress set forth in claim 1 wherein the pigment is generally the same color as the ticking.

5. The mattress set forth in claim 1 wherein the pigment is grey.

6. The mattress set forth in claim 1 wherein the interior means further comprises a plurality of inner springs.

7. The mattress set forth in claim 1 wherein the interior means further comprises a water bladder.

8. A mattress construction comprising:

interior means having compression characteristics for enhancing the comfort of a person lying on the mattress;

exterior means for enclosing the interior means and for providing a surface adapted to contact the person lying on the mattress;

a fabric included in the exterior means and having an inner surface and an outer surface, the fabric comprising threads of warp and woof which are woven with sufficient space therebetween to see through the interstices of the threads;

first pigments of a first color visible on the outer surface of the fabric and forming a pattern thereon;

a foam background material included in the exterior means and having a particular surface disposed in close proximity to the inner surface of the fabric;

second pigments of a second color included in the foam background material and visible at the particular surface of the background material and through the interstices of the threads of the fabric;

the second color being at least as dark as the first color; whereby the pattern on the fabric is enhanced in color quality.

9. The mattress recited in claim 8 wherein the interior means includes a plurality of inner springs.

10. The mattress recited in claim 8 wherein the interior means includes a water bladder.

11. The mattress recited in claim 8 wherein the first color is other than gold or yellow, and the second color is grey.

12. The mattress recited in claim 8 wherein the first color is gold or yellow and the second color is yellow.

13. The mattress recited in claim 8 wherein the second color is generally the same color as the first color.

14. The mattress recited in claim 8 wherein the background material is sewn to the fabric.

15. The mattress recited in claim 14 wherein:

the foam is urethane initially having a generally white color which degrades to a generally yellow color in response to age and ultraviolet light;

the second pigments having characteristics for maintaining the second color in response to age and ultraviolet light;

the second color dominating over the degraded yellow color of the foam; whereby when viewed through the fabric, the background material appears to maintain the second color in response to age and ultraviolet light.

16. A mattress construction including:

interior means having characteristics for enhancing the comfort of a person lying on the mattress;

exterior means for enclosing the interior means, the exterior means providing a surface adapted to contact the person lying on the mattress;

a ticking included in the interior means in the form of a loosely woven fabric having indicia thereon;

a fiber backing material included in the exterior means between the ticking and the interior means, said backing material being visible through the loosely woven fabric;

a color pigment included in the backing material and providing a colored background for the ticking and the indicia thereon; whereby the colored background provides an increase in the color quality of the ticking and the indicia on the fabric.

* * * * *